United States Patent [19]

Greenway

[11] Patent Number: 4,878,599

[45] Date of Patent: Nov. 7, 1989

[54] CAULKING NOZZLE

[76] Inventor: John M. Greenway, 44 Spruce Dr., Westwood, Mass. 02090

[21] Appl. No.: 92,464

[22] Filed: Sep. 3, 1987

[51] Int. Cl.[4] ..... B65D 25/42

[52] U.S. Cl. ..... 222/1; 222/566; 222/575

[58] Field of Search ..... 222/575, 566, 325, 326, 222/327, 341, 1, 567–568, 572; 239/601, 104, 590.5

[56] References Cited

FOREIGN PATENT DOCUMENTS 3015892 10/1981 Fed. Rep. of Germany ..... 222/566
199235 6/1923 United Kingdom ..... 222/566

*Primary Examiner*—Kevin P. Shaver

[57] ABSTRACT

A nozzle for a tube comprising material to be expelled through the nozzle in a direction from the tube to an outlet at the end of the nozzle opposite the tube, the material being hardenable upon exposure to air and residual material at the tip of the nozzle forming a hardened plug, the nozzle comprising: a series of hollow members, the members having a first and second end wherein the first end has a first inner cross-sectional dimension and the second end has a second inner cross-sectional dimension, wherein the second dimension is at least as great as the first dimension, the first dimension being different for each member, wherein the member having the largest the first dimension is at one end of the nozzle and the member having the smallest dimension is at the other end of the nozzle, the members being positioned between the largest and the smallest dimensioned members in order of decreasing the dimensions in the direction of the material is to be expelled and, whereby the series forms a hollow vessel having a stepwise decreasing inner cross-sectional first dimension, wherein the largest dimensioned member comprises an opening at one end suitable for connection to the tube, and wherein the members are of a length greater than the length of the plug.

11 Claims, 1 Drawing Sheet

CAULKING NOZZLE

BACKGROUND OF THE INVENTION

This invention relates to nozzle design on caulking tubes.

Caulking material is generally applied using a caulking gun into which a tube containing caulking material is placed. Referring to FIG. 1, such a tube A is shown. At the end of this tube is a sealed nozzle 1. Nozzle 1 is conically-shaped so that the user can control the diameter of the caulking material as it leaves nozzle 1 simply by cutting nozzle 1 at the desired diameter. For example, when nozzle 1, sealed at end 2, is cut at position 3 a thin diameter stream of caulking material will be obtained when it is pushed out of tube A and leaves nozzle 1. However, when a cut is made at position 4, a much wider diameter stream will be obtained. Thus, the user can choose from an almost infinite number of diameters simply by cutting the nozzle at the chosen place.

SUMMARY OF THE INVENTION

In a first aspect, the invention features a nozzle for a tube comprising material to be expelled through the nozzle in a direction from the tube to an outlet at the end of the nozzle opposite the tube, the material being hardenable upon exposure to air and material at the tip of the nozzle forming a hardened plug when exposed to air. The nozzle comprises a series of hollow members, the members having a first and second end wherein the first end has a first inner cross-sectional dimension and the second end has a second inner cross-sectional dimension, wherein the second dimension is at least as great as the first dimension, the first dimension being different for each member, wherein the member having the largest first dimension is at one end of the nozzle and the member having the smallest dimension is at the other end of the nozzle, other members being positioned between the largest and the smallest dimensioned members in order of decreasing dimensions in the direction of flow of material from the nozzle. The series of members forms a hollow vessel having a stepwise decreasing inner cross-sectional first dimension, wherein the largest dimensioned member comprises an opening at one end suitable for connection to the tube, and wherein the members are of a length greater than the length of the plug.

In preferred embodiments, the length of each member is at least 0.5 cm, most preferably at least 1 cm; the inner cross-sectional dimension is circular; the smallest dimension is 2 mm in diameter and the largest dimension is 10 mm; and the first cross-sectional dimension and the second cross-sectional dimension are equal.

In a second aspect, the invention features a nozzle for a tube comprising hardenable material to be expelled through the nozzle in a direction from the tube to an outlet at the end of the nozzle opposite the tube. The nozzle comprises a series of hollow members, wherein material hardening in a member is readily extrudable from the member in the direction the material is to be expelled, and wherein the material hardens upon exposure to air only to a depth less than the depth of a member.

In a third aspect, the invention features a kit comprising a nozzle suitable for extruding material from a tube, for example, as described in either of the above aspects, and a cap, the cap being sized to sealing fit over the end of one member.

In other embodiments the invention features a tube attached to the above nozzles.

This invention provides a nozzle for caulking tubes, or tubes containing similar material, which allows only a finite number of choices of the material stream diameter, but overcomes the problems of nozzle blockage. Nozzle blockage is observed when a nozzle, e.g., a conical nozzle, having a decreasing diameter towards the end of the nozzle is used. When the material inside the nozzle hardens (as it generally does for about ½ cm from the nozzle end) it is extremely difficult to extrude the hardened material so that more material can be expressed from the tube, because the hardened material has a wider diameter at the end furthest from the open end, than does the open end. In contrast, this invention provides a nozzle which allows material to harden within the nozzle without causing permanent blockage of the nozzle. Since the nozzle is provided with regions having the same or less diameter for a length of the nozzle upstream of the outlet of the nozzle, any material hardening in this region is readily expressed from the nozzle simply by applying pressure to material in the tube furthest from the open end of the nozzle.

Other features and advantages of the invention will be apparent from the following description of the preferred embodiments, and from the claims.

DESCRIPTION OF THE PREFERRED EMBODIMENT

The Figures will first briefly be described. Drawings

STRUCTURE

Figure 1:
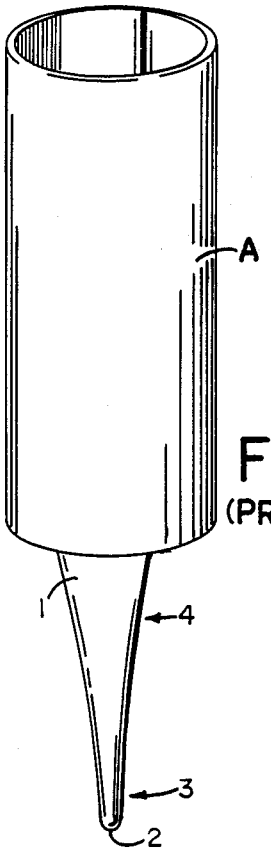
FIG. 1 (PRIOR ART)
FIG. 1 is a diagrammatic representation of a prior art nozzle.
Figure 2:
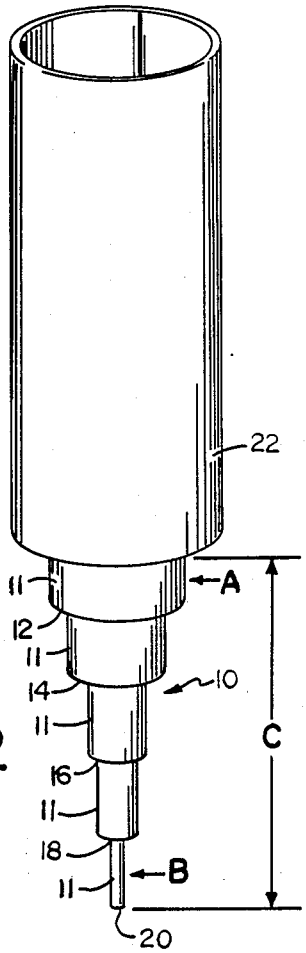
FIG. 2 is a diagrammatic representation of a nozzle of the invention.

Referring to FIG. 2, nozzle 10 is constructed from a hard plastic, as in prior art nozzles, and consists of a series of contiguous hollow members 11 separated by steps 12, 14, 16, 18. Members 11 are of length 1 cm. Each step represents a region of decreasing nozzle internal diameter, from 10 mm at point A to 2 mm at point B in 2 mm decrements. Nozzle 10 has a sealed tip 20 and is attached to container 22 by standard techniques. Nozzle 10 has an overall length C of 5 cm, and is hollow, having a wall thickness of 2 mm. It is manufactured by standard methods.

Use

Figure 3:
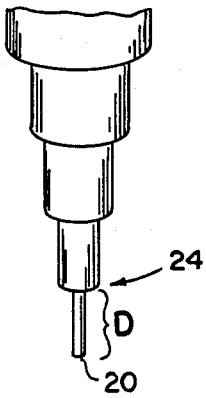
FIG. 3 is a longitudinal section through a nozzle.

When starting to use the material inside container 22, the desired nozzle diameter is chosen and nozzle 10 is cut using a razor blade to remove that part of the nozzle immediately above the desired size. For example, if a diameter of 2 mm is desired, only the extreme tip 20 of the nozzle is removed; if a diameter of 4 mm is desired, the whole of the 2 mm section (region D) and the extreme tip of the 4 mm section is removed as shown by the arrow 24 in FIG. 3. Thus, the nozzle has an opening corresponding to the desired diameter, and an almost 1 cm length of nozzle, corresponding to this diameter.

Figure 4:
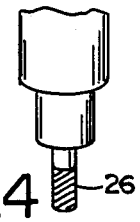
FIGS. 4, 4A are longitudinal sections through a nozzle showing expulsion of hardened material.
Figure 4A:
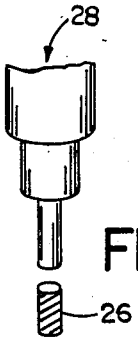

The nozzle is used to position material from container 22 in a normal manner. Referring to FIGS. 4, **4*a*, after use material remaining in the nozzle will harden to a depth of about ½–¾ cm (shown in FIG. 4**, as hardened material 26) from the open end of the nozzle. Thus, hardened material 26 will only be present in the length of nozzle corresponding to the desired diameter. This means that when the nozzle is next uesd (FIG. 4A) the parallel-sided core of hardened material can be readily expelled, along the parallel sides of this section of the nozzle, by applying pressure to the tube containing the material to be extruded, as shwon by arrow 28.

OTHER EMBODIMENTS

Other embodiments are within the following claims. For example, rather than relying on hardened material being readily expelled, caps corresponding in inner diameter to the outer diameter of each step of nozzle 10, can be placed over any corresponding open stretch of nozzle to prevent the material from hardening. Further, it is advantageous to produce a nozzle in which the sections do not have parallel sides (i.e., have the same cross-section along their length), rather the end nearest the tube is narrower than that nearer the tip of the nozzle. When the material hardens it can be pushed out from this section more easily than from a section with parallel sides.

I claim:

1. A tube assembly comprising a tube comprising hardenable material to be extruded through a nozzle in a direction from said tube to an outlet at the end of said nozzle opposite said tube, said material being hardenable upon exposure to air and material at the tip of said nozzle forming a hardened plug of a known length when exposed to air, comprising a nozzle comprising:

a series of hollow members, said members having a first and second end wherein said first end has a first inner cross-sectional dimension and said second end has a second inner cross-sectional dimension, wherein said second dimension is at least as great as said first dimension, said first dimension being different for each said member, wherein the member having the largest said first dimension is at one end of said nozzle and the member having the smallest said dimension is at the other end of said nozzle, other said members beings positioned between said largest and said smallest dimensioned members in order of decreasing said dimensions in said direction, whereby said series forms a hollow vessel having a stepwise decreasing inner cross-sectional first dimension, wherein said largest dimensioned member comprises an opening at one end suitable for connection to said tube, and wherein said members are of a length greater than the length of said plug and wherein said material hardens upon exposure to air only to a depth less than the depth of a said member.

2. The tube of claim 1 wherein the length of said members are at least 0.5 cm.

3. The tube of claim 1 wherein the length of said members are at least 1 cm.

4. The tube of claim 1 wherein said inner cross-sectional dimension is circular.

5. The tube of claim 1 wherein said first inner cross-sectional dimension and said second inner cross-sectional dimension are equal.

6. A kit comprising the tube of claim 1 and a cap, said cap being sized to sealing fit over the end of one said member.

7. A method for removing hardenable material from a nozzle, comprising the steps of:

providing the tube assembly of claim 1, applying pressure to said tube to extrude said material from said tube through said nozzle, allowing material at the end of said nozzle to harden, and applying pressure to said tube to extrude the hardened material.

8. The tube of claim 1, said material being caulking material.

9. A tube comprising hardenable material to be extruded comprising a nozzle wherein said material is expelled through said nozzle in a direction from the tube to an outlet at the end of the nozzle opposite the tube, said nozzle comprising a series of hollow members wherein said material hardening in a said member is readily extrudable from said member in said direction, and wherein said material hardens upon exposure to air only to a depth less than the depth of a said member.

10. A kit comprising the tube of claim 9 and a cap, said cap being sized to sealing fit over the end of one said member.

11. The tube of claim 9, said material being caulking material.

* * * * *